US005524430A

United States Patent [19]

Mazeaud et al.

[11] Patent Number: 5,524,430

[45] Date of Patent: Jun. 11, 1996

[54] GAS-TURBINE ENGINE WITH DETACHABLE COMBUSTION CHAMBER

[75] Inventors: Georges Mazeaud, Yerres; Christophe Pieussergues; Denis J. M. Sandelis, both of Nangis, all of France

[73] Assignee: Societe National D'Etude et de Construction de Moteurs D'Aviation S.N.E.C.M.A., Paris, France

[21] Appl. No.: 4,606

[22] Filed: Jan. 14, 1993

[30] Foreign Application Priority Data

Jan. 28, 1992 [FR] France ..... 92 00853

[51] Int. Cl.[6] ..... F02G 1/00

[52] U.S. Cl. ..... 60/39.31; 60/752

[58] Field of Search ..... 60/39.31, 39.32, 60/752

[56] References Cited

U.S. PATENT DOCUMENTS

| | | | |
|---|---|---|---|
| 3,500,639 | 3/1970 | Stamm | 60/39.31 |
| 4,487,015 | 12/1984 | Slattery et al. | 60/39.32 |
| 4,525,996 | 7/1985 | Wright et al. | 60/39.32 |
| 5,154,060 | 10/1992 | Walker et al. | 60/752 |
| 5,197,289 | 3/1993 | Glevicky et al. | 60/752 |

FOREIGN PATENT DOCUMENTS

| | | |
|---|---|---|
| 0244342 | 4/1987 | European Pat. Off. . |
| 607824 | 9/1948 | United Kingdom . |
| 1010338 | 11/1965 | United Kingdom . |
| 1132940 | 11/1968 | United Kingdom . |
| 2135440 | 8/1984 | United Kingdom . |

*Primary Examiner*—Timothy S. Thorpe
*Attorney, Agent, or Firm*—Bacon & Thomas

[57] ABSTRACT

A combustion chamber for a gas-turbine engine is disclosed in which the walls defining the combustion chamber may be easily attached to and removed from the engine structure. A dome member is attached to the engine structure such that it partially encloses the fuel injector nozzle in an upstream direction. The shape of the dome-member is such that it splits the incoming oxidizer flow into inner and outer flows which pass along the inner and outer sides of the combustion chamber. The inner and outer walls of the combustion chamber may be attached to an upstream end wall of the combustion chamber such that this assembly is removable as a unit from the dome member. The inner and outer walls, as well as the end wall, are releasably attached to the dome member such that the assembly can be removed from the gas-turbine engine without the necessity of removing or displacing the fuel injector nozzles or the dome member. Alternatively, the end wall of the combustion chamber is fixedly attached to the dome member while the inner and outer walls of the combustion chamber are releasably attached to the end wall. This enables the inner and outer walls to be separately removed from the gas-turbine engine, again without disturbing the fuel injector nozzles or the dome member.

17 Claims, 5 Drawing Sheets

GAS-TURBINE ENGINE WITH DETACHABLE COMBUSTION CHAMBER

BACKGROUND OF THE INVENTION

1. Field of the Invention

The present invention relates to a combustion chamber for a gas-turbine engine, more particularly such a combustion chamber which may be easily removed from the gas-turbine engine for maintenance purposes.

2. Description of Related Art

In order to reduce the pollution caused by exhaust gases, modern gas-turbine engines typically have annular combustion chambers with several rows of fuel injectors. One row of fuel injectors is primarily utilized during low power engine operation, while other rows of fuel injectors are the primary fuel injectors during full power engine operation.

Because of the multiple rows of fuel injectors, the combustion chambers of these gas-turbine engines are enlarged and bulky at their upstream ends. The optimum design of the combustion chamber is thereby deleteriously affected in order to obtain the proper pressure differential of the gases passing through the end of the combustion chamber.

It is also known to provide a diffuser on the upstream end of the combustion chamber in order to split the incoming flow of oxidizer gas in order to direct it toward the radially outer end radially inner sides of the annular combustion chamber.

SUMMARY OF THE INVENTION

A combustion chamber for a gas-turbine engine is disclosed in which the walls defining the combustion chamber may be easily attached to and removed from the engine structure. A dome member is attached to the engine structure such that it partially encloses the fuel injector nozzle in an upstream direction. The shape of the dome-member is such that it splits the incoming oxidizer flow into inner and outer flows which pass along the inner and outer sides of the combustion chamber. The inner and outer walls of the combustion chamber may be attached to an upstream end wall of the combustion chamber such that this assembly is removable as a unit from the dome member. The inner and outer walls, as well as the end wall, are releasably attached to the dome member such that the assembly can be removed from the gas-turbine engine without the necessity of removing or displacing the fuel injector nozzles or the dome member.

In alternative embodiments, the end wall of the combustion chamber is fixedly attached to the dome member while the inner and outer walls of the combustion chamber are releasably attached to the end wall. This enables the inner and outer walls to be separately removed from the gas-turbine engine, again without disturbing the fuel injector nozzles or the dome member.

The dome member may define an opening to allow the oxidizer gas to pass through the dome member and, subsequently, through the air swirlers around the fuel injector nozzles.

The dome member, as well as the inner and outer walls and the end wall of the combustion chamber, are located in the space between an inner engine case and an outer engine case. The downstream portions of the inner and outer walls may be attached to the inner engine case and the outer engine case, respectively. Such attachment is a releasable attachment to facilitate the removal of the inner and outer walls.

In the structure according to this invention, the dome member is separate and distinct from the combustion chamber, which is defined by the inner wall, the outer wall and the upstream end wall. The dome member is attached to the inner and outer engine cases by locating pins extending radially inwardly from the outer engine case through a locating opening defined by the dome member. Attachment of the dome member to the inner case may be accomplished by a flexible member to enable relative expansion and contraction of the dome member and the combustion chamber with respect to the engine cases.

The main advantage of the structure of the present invention is the ease of disassembling the combustion chamber from the engine structure without the necessity of dismantling or otherwise disturbing the fuel injectors. At the same time, the mechanically strong dome member may be selected to have the proper aerodynamic profile to protect the fuel injector and the upstream end of the combustion chamber against damage caused by solid particles ingested into the gas-turbine engine, such as hail. The structure also provides the combustion chamber with increased mechanical strength and resistance to vibration, since the upstream end of the combustion chamber is not rigidly affixed to the engine cases.

When the walls defining the inner and outer boundaries of the annular combustion chamber are removed from the engine structure, the dome member and the upstream end of the combustion chamber, as well as the fuel injector, remain in place within the engine case. An additional advantage of this structure allows the precise location of the fuel injector position in the upstream end of the combustion chamber without such positions being effected by the axial displacement caused by thermal expansion and contraction. As a result, the efficiency of the combustion chamber may be fully optimized.

DETAILED DESCRIPTION OF THE PREFERRED EMBODIMENTS

Figure 1:
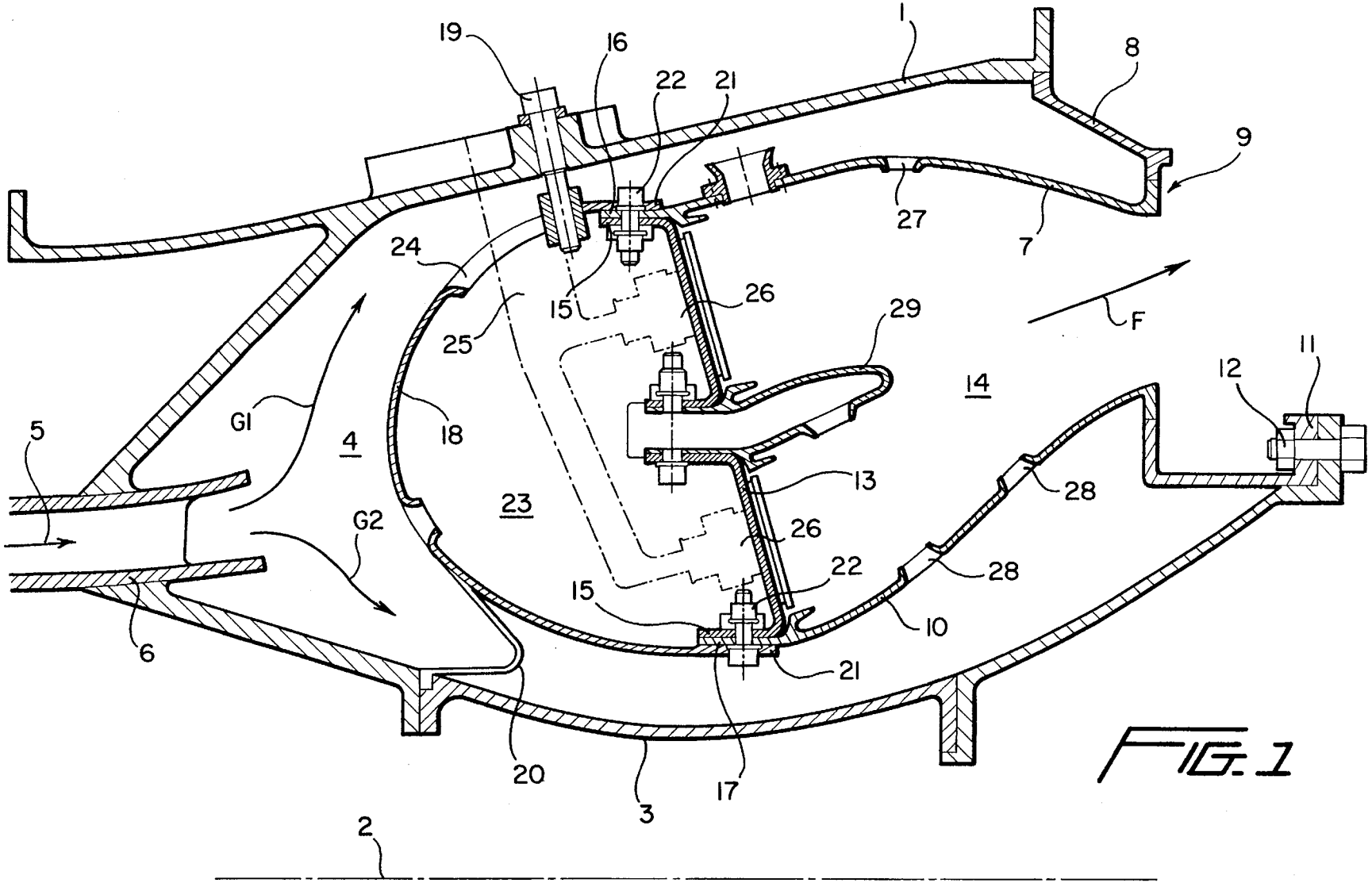
FIG. 1 is a partial, longitudinal, cross-sectional view taken along a first plane extending through the longitudinal axis of the gas-turbine engine showing a first embodiment of the combustion chamber according to the present invention.
Figure 2:
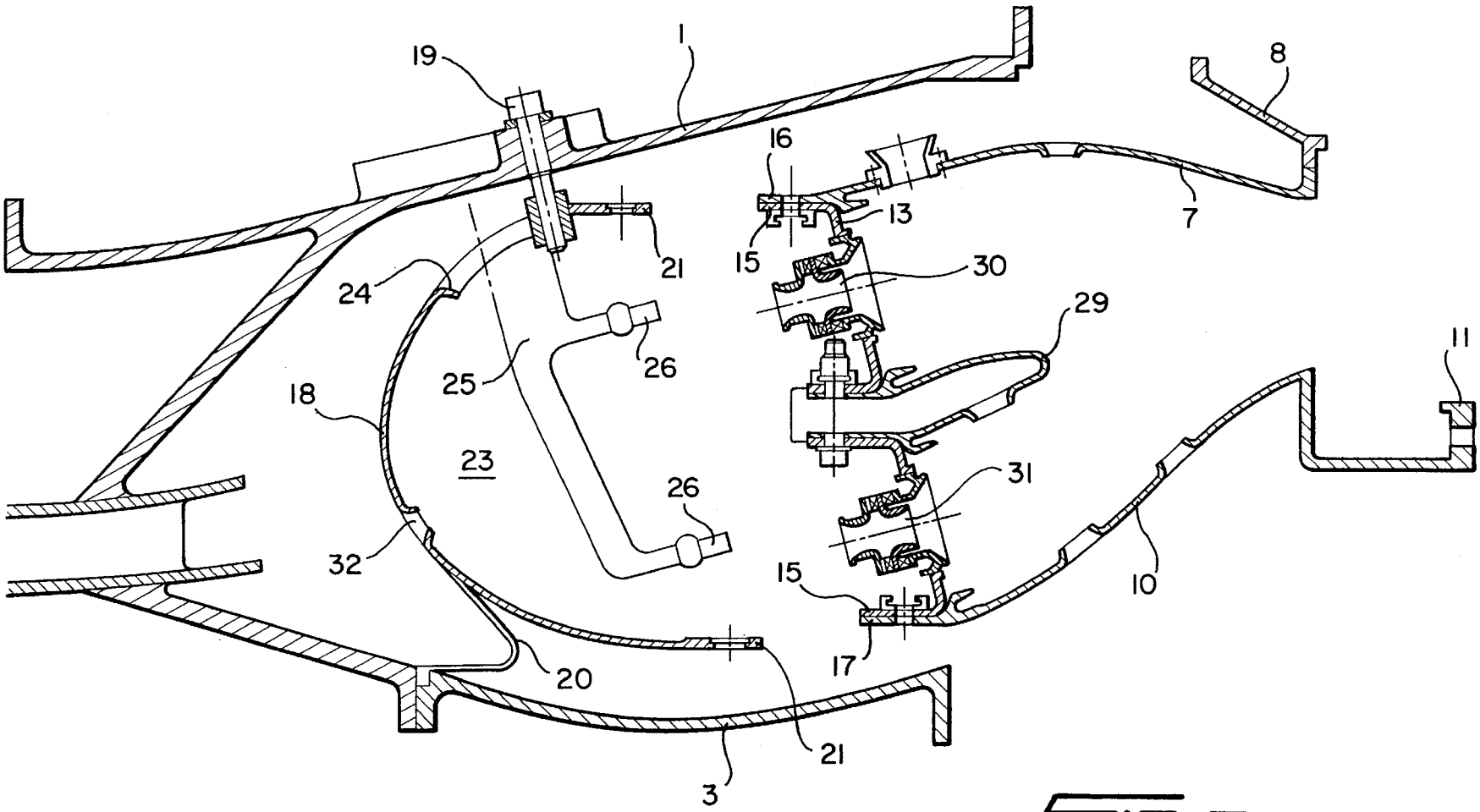
FIG. 2 is an exploded, partial, longitudinal, cross-sectional view taken along a circumferentially displaced plane showing the disassembly of the structure of FIG. 1.

A first embodiment of the combustion chamber according to the present invention is illustrated in FIGS. 1 and 2. The structure comprises an outer engine case 1 and an inner engine case 3 spaced therefrom so as to define space 4 between the inner and outer engine cases. It is to be understood that engine cases 1 and 3 are generally annular in configuration and extend about longitudinal axis 2.

Space 4 between the outer engine case 1 and the inner engine case 3 receives compressed oxidizer, such as air, from a source (not shown), which may be a stage of an upstream compressor, in the direction of arrow 5 passing through inlet oxidizer conduit 6.

Outer combustion chamber wall 7, which extends generally in an axial direction, has a downstream, outlet end 9 which is attached to the outer engine case 1 by bracket 8. The bracket 8 flexibly fastens the combustion chamber outlet end 9 to the outer case 1.

The opposite side of the generally annular combustion chamber 14 is defined by inner wall 10 which has a downstream portion with a flange 1 and which is attached to a downstream portion of the inner engine case 3 via bolts 12, or the like.

The upstream end of the combustion chamber 14 is defined by end wall 13 which has flanged portions 15. In this embodiment, upstream end portions 16 and 17 of the outer wall 7 and the inner wall 10, respectively, are fixedly attached to the flanges 15 of the end wall 13, such as by welding.

A dome member 18 is affixed to one of the engine cases, in this particular instance case 1 by a plurality of retaining pins 19 which threadingly engage the engine case 1 and extend radially inwardly thereof through locating holes defined by the dome member 18. The dome member 18 is connected to the inner case 3 by flexible pads 20. The downstream portion of dome member 18 defines flanges 21 which are affixed to flanges 15 of end wall 13, as well as upstream portions 16 and 17 of the combustion chamber walls 7 and 10 by a plurality of bolts 22.

The dome member 18 defines, along with the upstream side of the end wall 13, a space 23 in which is located fuel injector nozzles 26 and fuel supply conduit 25. Fuel supply conduit 25 extends outwardly though an opening 24, defined by the dome member 18, which is substantially larger than the fuel supply conduit 25 to enable oxidizer from space 4 to pass through the dome member 18 into space 23. As can be seen, the dome member 18 is completely separate from the structure defining the combustion chamber 14 and is located upstream of the combustion chamber in which the burned gases flow in the direction of arrow F.

As can be seen, the fuel injector comprises two annular rows of fuel injector nozzles 26 which are supplied by the fuel conduit 25. The end wall 13 define feed orifices 30 and 31 which are aligned with the fuel injector nozzles 26 to enable the fuel to be sprayed into the combustion chamber 14.

Dome member 18 is also aerodynamically profiled to divide the oxidizer flowing into the space 4 into oxidizer flows G1 and G2 which are directed toward the outer and inner sides of the combustion chamber, respectively. These air flows pass into the combustion chamber via orifices 27 and 28 defined by the outer and inner walls 7 and 10, respectively.

Member 29 is affixed to the end wall 13 and extends generally axially into the combustion chamber 14 between the feed orifices 30 and 31 to maintain separation of the fuel injected through nozzles 26 in the upstream portion of the combustion chamber. The dome member 18 may also define orifices 32 to complete the oxidizer input into the dome 18.

As illustrated in FIG. 2, once the bolts 12 and 22 have been removed, it is possible to remove the combustion chamber as an integral unit from the gas-turbine engine structure. This sub-assembly comprises the outer wall 7, the inner wall 10 and the end wall 13 with its associated structures. As can be seen, the dome member 18 and the fuel injector nozzles 26 remain attached to the engine case and are completely undisturbed by the removal of the combustion chamber structure.

Figure 3:
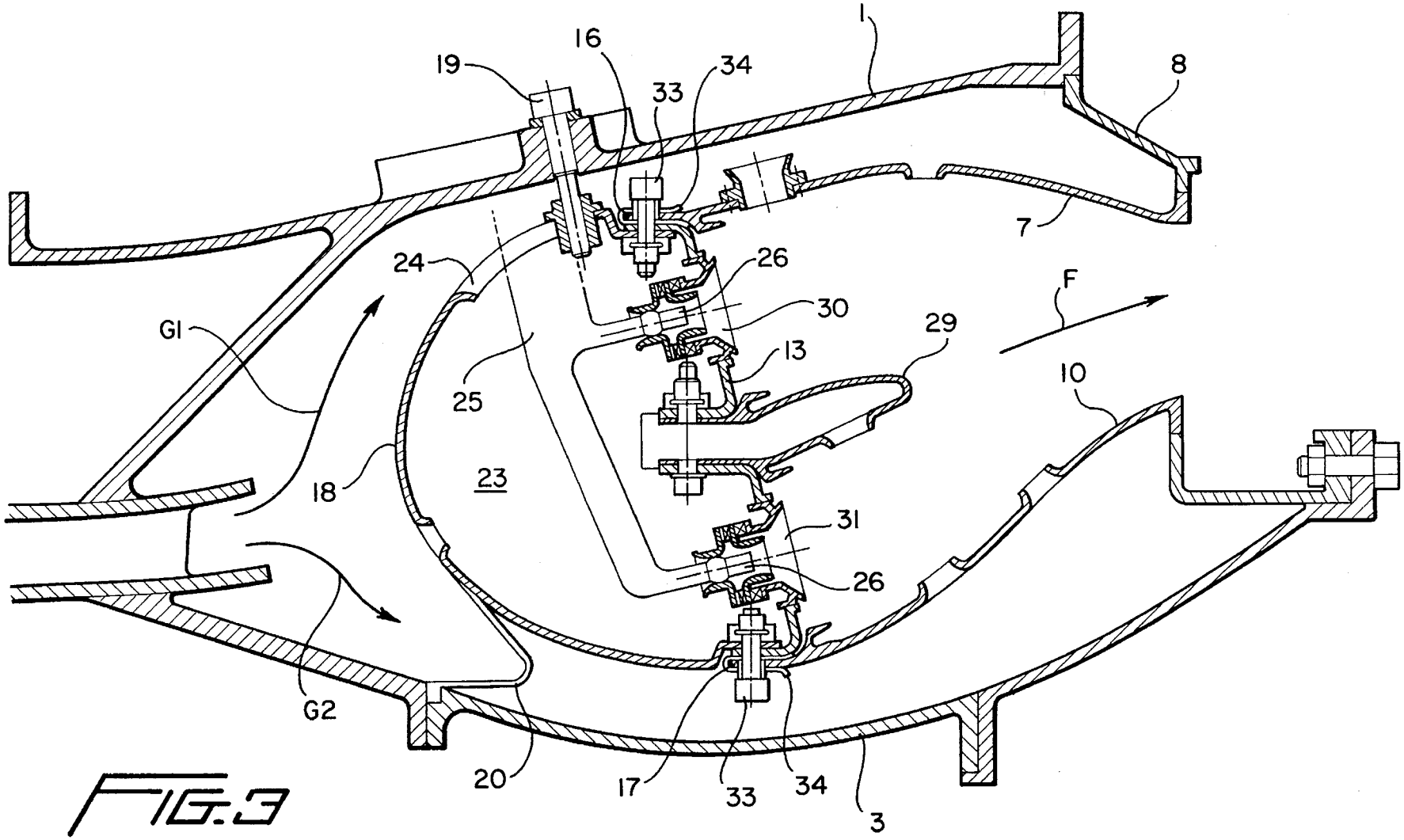
FIG. 3 is a partial, longitudinal, cross-sectional view illustrating a second embodiment of the present invention.
Figure 4:
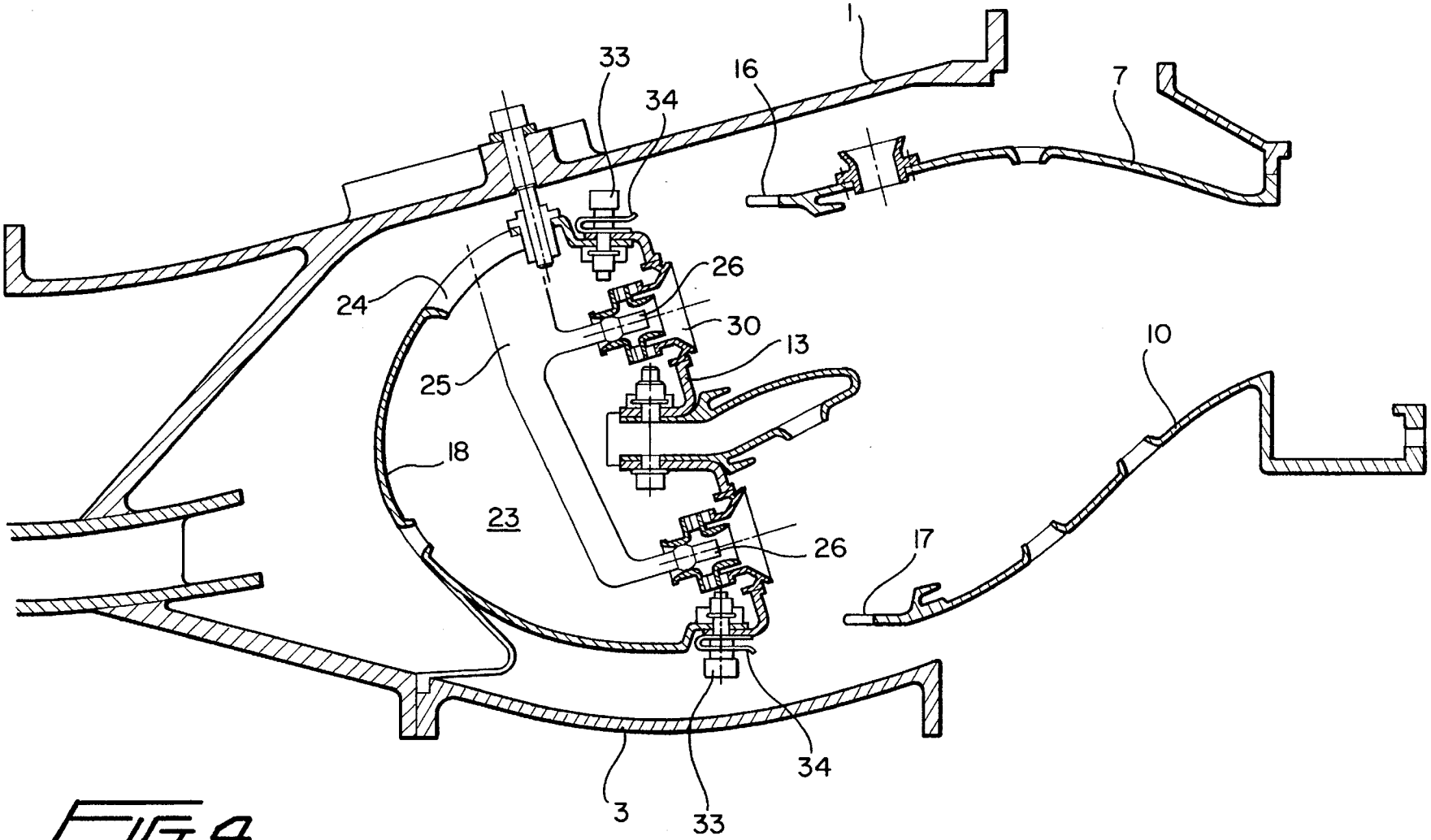
FIG. 4 is partial, longitudinal, exploded, cross-sectional view of the combustion chamber embodiment illustrated in FIG. 3.

A second embodiment of the present invention is illustrated in FIGS. 3 and 4 and is substantially the same as that illustrated in FIGS. 1 and 2, except for the attachment of the inner and outer walls 7 and 10 to the end wall 13. In this embodiment, the end wall 13 is not fixedly attached to the inner and outer walls 7 and 10, but such inner and outer walls 7 and 10 are releasably attached to the end wall 13. This allows the end wall 13 to be fixedly attached to the dome member 18 such that disassembly of the combustion chamber structure entails only the removal of outer walls 7 and 10, as illustrated in FIG. 4. The upstream ends 16 and 17 of the outer wall 7 and the inner wall 10 are releasably attached to the end wall 13 by clips 34 which may be fixedly attached to the end wall flanges 15. As can be seen in FIGS. 3 and 4, the clips 34 face generally in a downstream direction and releasably accommodate the upstream ends 16 and 17 of the walls 7 and 10, respectively. End wall 13 may be attached to flanges 21 of the dome member 18 via bolts 33 or the like. In order to accommodate the axial movement of the outer wall 7 and the inner wall 10 necessary for attachment to the clips 34, the upstream end portions 16 and 17 may be axially slotted to accommodate the bolts 33.

Thus, in this embodiment, the end wall 13 remains attached to the dome member 18 when the combustion chamber is disassembled by removing the outer wall 7 and the inner wall 10.

Figure 5:
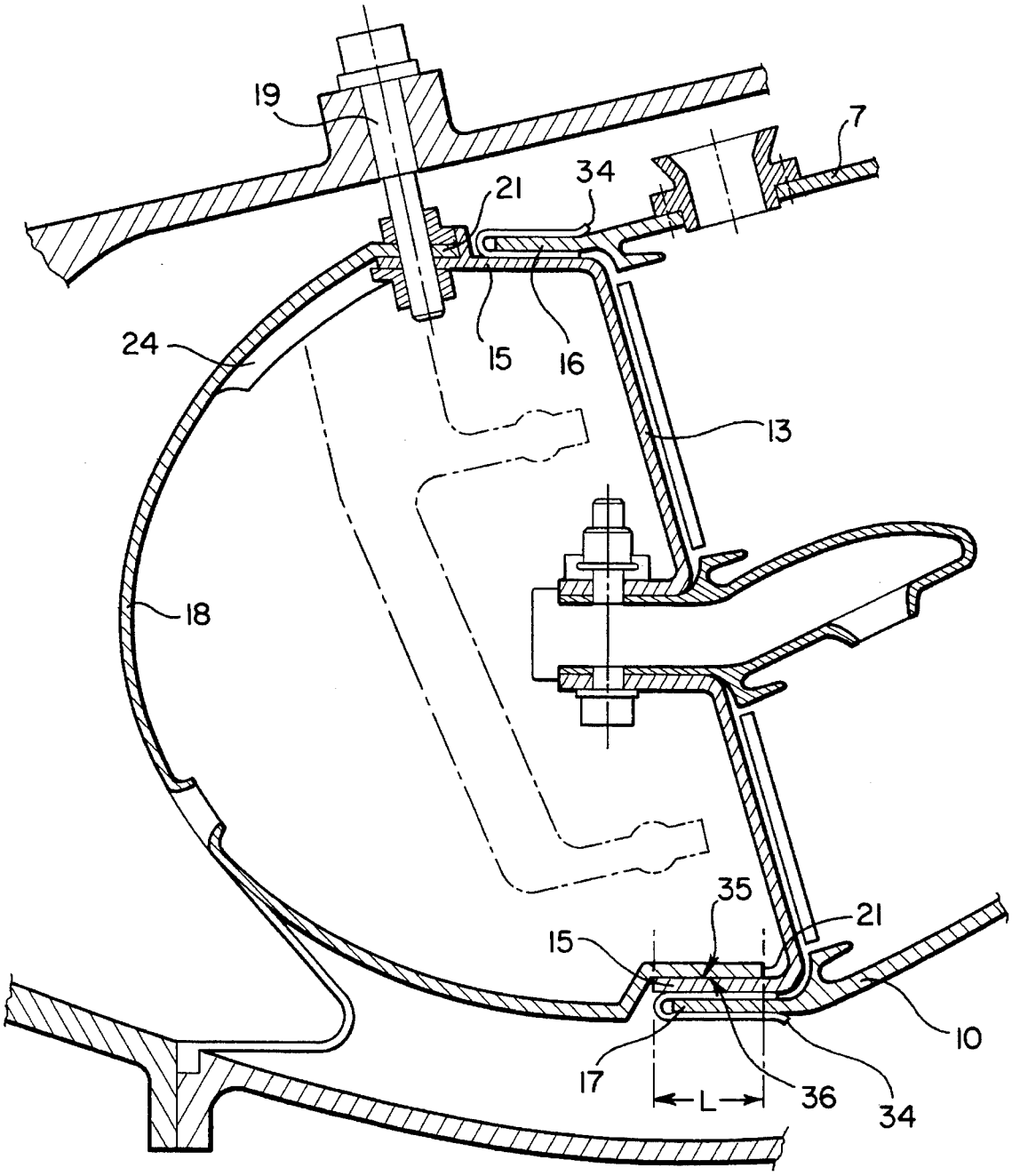
FIG. 5 is a partial, longitudinal, cross-sectional view of a third embodiment of the combustion chamber according to the present invention.

A third embodiment is illustrated in FIG. 5 in which the outer wall 7 and inner wall 10 are releasably attached to the end wall 13 via clips 34. In this embodiment, the bolts 33 attaching the end wall 13 to the dome member 18 are eliminated and the end wall 13 is attached to the dome member via the attaching pins 19. As can be seen, the flange 15 extends axially further in an upstream direction and defines openings which accommodate the radially inner extending portions of the pins 19. This prevents any axial movement between the end wall 13 and the dome member 18. The end wall 13 is centered with respect to the dome member 18 by the engagement of centering surface 35, formed as part of the flange 15 of the end wall 13, and centering surface 36 which is formed on the downstream portion 21 of the dome member 18. The axial length L of the centering surfaces 35 and 36 must be sufficient to achieve the desired centering function.

In all of the foregoing embodiments, the dome member 18, which is located upstream of the fuel injectors and the combustion chamber 14, prevents any damage to these elements by any particles, such as hail, which may be drawn into the gas-turbine engine and enter the space 4. Dome member 18 prevents any direct contact between such particles and the fuel injection nozzles 26 and the air intake swirlers of the combustion chamber 14. Thus, any danger of combustion extinction caused by such hail particles is eliminated by this invention.

Retaining pins 19 and flexible pad mounting structure 20 make it possible to affix the dome member 18 to the engine cases in an elastic manner to thereby allow free axial and radial expansion of the dome member 18 and the combustion chamber 14 between the engine cases 1 and 3.

In the embodiment illustrated in FIG. 5, the combustion chamber structure may be disassembled by removing the walls 7 and 10 from the end wall 13. It is also possible to disassemble the end wall 13 from the dome member 18 by partially removing the locating pin 19 such that it is disengaged from flange 15. Again, as in the previous embodiments, disassembly of the combustion chamber does not require removal of the dome member 18, nor does it disturb the location of the fuel injectors 26.

The attachment of the upstream ends 16 and 17 of the outer wall 7 and the inner wall 10 to the downstream rim 21 of the dome member 18 enables the walls to be attached with improved mechanical strength and improved resistance to vibration.

The foregoing description is provided for illustrative purposes only and should not be construed as in any way limiting this invention, the scope of which is defined solely upon the appended claims.

What is claimed is:

1. A combustion chamber for a gas-turbine engine having a generally annular outer case, a generally annular inner case spaced therefrom and oxidizer inlet means to allow oxidizer to pass into the space between the inner and outer cases, the combustion chamber comprising:

a) a dome cowl member having a generally annular configuration and defining at least one opening to allow oxidizer in the space between the inner and outer case to pass through;

b) first attachment means to attach the dome cowl member to the inner and outer cases such that the dome cowl member is located in the space between the inner and outer cases, wherein the first attachment means comprises:

i) at least one locating hole defined by the dome cowl member;

ii) at least one pin member attached to and extending inwardly from the outer case so as to engage the at least one locating hole; and, iii) a flexible member extending between the dome member and the inner case;

c) first wall means forming an outer wall of the combustion chamber;

d) second wall means forming an inner wall of the combustion chamber;

e) third wall means forming an upstream end wall of the combustion chamber;

f) second attachment means to attach the first and second wall means to the third wall means;

g) third attachment means to releasably attach the third wall means to the dome cowl member such that the first, second and third wall means may be detached from the dome cowl member while the dome cowl member remains attached to the inner and outer cases;

h) at least one fuel injection nozzle located between the dome cowl member and the third wall means;

i) a fuel supply line operatively connected to the at least one fuel injector nozzle to supply fuel thereto and passing through the at least one opening in the dome cowl member;

j) fourth attachment means to releasably attach the first wall means to the outer case; and, k) fifth attachment means to releasably attach the second wall means to the inner case.

2. The combustion chamber of claim 1 wherein the fuel supply line is operatively associated with two fuel injection nozzles.

3. The combustion chamber of claim 1 wherein the second attachment means fixedly attaches the first and second wall means to the third wall means.

4. The combustion chamber of claim 1 wherein the third attachment means comprises a plurality of bolt means passing through holes defined by the dome cowl member and the third wall means.

5. A combustion chamber for a gas-turbine engine having a generally annular outer case, a generally annular inner case spaced therefrom and oxidizer inlet means to allow oxidizer to pass into the space between the inner and outer cases, the combustion chamber comprising:

a) a dome cowl member;

b) first attachment means to attach the dome cowl member to the inner and outer cases such that the dome member is located in the space between the inner and outer cases wherein the first attachment means comprises:

i) at least one locating hole defined by the dome cowl member;

ii) at least one pin member attached to and extending inwardly from the outer case so as to engage the at least one locating hole; and, iii) a flexible member extending between the dome cowl member and the inner case;

c) first wall means forming an outer wall of the combustion chamber;

d) second wall means forming an inner wall of the combustion chamber; and, e) second attachment means to releasably attach the first and second wall means to the dome cowl member such that the first and second wall means may be detached from the dome cowl member while the dome cowl member remains attached to the inner and outer cases.

6. The combustion chamber of claim 5 wherein the second attachment means comprises:

a) third wall means forming an upstream end wall of the combustion chamber; and, b) means to releasably attach the first and second wall means to the third wall means.

7. The combustion chamber of claim 6 wherein the releasable attachment means comprises a plurality of clip means attached to the third wall means and adapted to releasably engage portions of the first and second wall means.

8. The combustion chamber of claim 6 further comprising third attachment means to attach the third wall means to the dome cowl member comprising a plurality of bolt means passing through holes defined by the dome cowl member and the third wall means.

9. The combustion chamber of claim 6 wherein the first attachment means comprises:

a) at least one locating hole defined by the dome cowl member; and, b) at least one pin member attached to and extending inwardly from the outer case so as to engage the at least one locating hole.

10. The combustion chamber of claim 9 further comprising third attachment means to attach the third wall means to the dome cowl member comprising at least one second locating hole defined by the third wall means and adapted to receive the at least one pin member.

11. The combustion chamber of claim 5 further comprising at least one opening defined by the dome cowl member adapted to allow oxidizer in the space between the inner and outer case to pass therethrough.

12. The combustion chamber of claim 5 further comprising:

a) third wall means forming an upstream end wall of the combustion chamber;

b) at least one fuel injection nozzle located between the dome cowl member and the third wall means; and, c) a fuel supply line operatively connected to at least one fuel injector nozzle to supply fuel thereto.

13. The combustion chamber of claim 12 further comprising at least one opening defined by the dome cowl member adapted to allow oxidizer in the space between the inner and outer cases to pass therethrough and sized so as to allow the fuel supply line to pass through at least one opening.

14. The combustion chamber of claim 12 wherein the fuel supply line is operatively associated with two fuel injection nozzles.

15. The combustion chamber of claim 5 further comprising:

a) third wall means forming an upstream end wall if the combustion chamber and wherein the second attachment means fixedly attaches the first and second wall means to the third wall means; and, b) third attachment means to releasably attach the third wall means to the dome cowl member such that the first, second and third wall means may be detached from the dome cowl member as a unit.

16. The combustion chamber of claim 15 wherein the third attachment means comprises a plurality of bolt means passing through holes defined by the dome cowl member and the third wall means.

17. The combustion chamber of claim 5 further comprising:

a) third wall means forming an upstream end wall of the combustion chamber; and, b) third attachment means to attach the third wall means to the dome cowl member wherein the second attachment means comprises a plurality of clip means attached to the third wall means and adapted to releasably engage portions of the first and second wall means.

* * * * *